US012595569B2

(12) United States Patent
Cao et al.

(10) Patent No.: US 12,595,569 B2
(45) Date of Patent: Apr. 7, 2026

(54) SYSTEMS AND METHODS FOR WATER ELECTROLYSIS WITH ELECTRODES HAVING TRANSITION METAL-PHOSPHOROUS-BASED COMPOUNDS

(71) Applicant: HONEYWELL INTERNATIONAL INC., Charlotte, NC (US)

(72) Inventors: Gangmin Cao, Shanghai (CN); Jingkang Lv, Shanghai (CN); Jin Qiu, Shanghai (CN); Zhenchuang Huang, Shanghai (CN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 715 days.

(21) Appl. No.: 17/937,000

(22) Filed: Sep. 30, 2022

(65) Prior Publication Data

US 2024/0110288 A1 Apr. 4, 2024

(51) Int. Cl.
*C25B 1/04* (2021.01)
*C25B 9/23* (2021.01)
(Continued)

(52) U.S. Cl.
CPC ..... *C25B 1/04* (2013.01); *C25B 9/23* (2021.01); *C25B 11/036* (2021.01);
(Continued)

(58) Field of Classification Search
CPC ..... C25B 9/23; C25B 11/036
See application file for complete search history.

(56) References Cited

U.S. PATENT DOCUMENTS

2007/0243452 A1 10/2007 Weidman et al.
2008/0160354 A1 7/2008 Zhang et al.
(Continued)

FOREIGN PATENT DOCUMENTS

CN 108360030 A 8/2018
WO 2017066949 A1 4/2017
(Continued)

OTHER PUBLICATIONS

XP071364214; Nan Jiang et al.; "Electrodeposited Cobalt-Phosphorous-Derived Films as Competent Bifunctional Catalysts for Overall Water Splitting"; Angewandte Chemie, Wiley-V C H Verlag Gmbh & Co. KGAA, DE; vol. 127 No. 21; Apr. 20, 2015; pp. 6349-6352; ISSN: 0044-8249; DOI: 10.1002/ANGE.201501616.

*Primary Examiner* — Brian W Cohen
(74) *Attorney, Agent, or Firm* — Ingrassia Fisher & Lorenz LLP

(57) ABSTRACT

Systems and methods are provided for water electrolysis. The system includes an ion exchange membrane, a first electrode catalyst layer on a first side of the ion exchange membrane, wherein the first electrode catalyst layer includes a transition metal-phosphorus-based compound on the first side of the ion exchange membrane, and a second electrode catalyst layer on a second side of the ion exchange membrane opposite the first side. In some embodiments, the first electrode catalyst layer is electroplated to the first side of the ion exchange membrane. In some embodiments, the second electrode catalyst layer includes a compound comprising the same transition metal as the first electrode catalyst layer.

7 Claims, 4 Drawing Sheets

(51) Int. Cl.

| | |
|---|---|
| ***C25B 11/036*** | (2021.01) |
| ***C25B 11/061*** | (2021.01) |
| ***C25B 11/089*** | (2021.01) |
| ***C25B 13/02*** | (2006.01) |

(52) U.S. Cl.
CPC ..... *C25B 11/061* (2021.01); *C25B 11/089* (2021.01); *C25B 13/02* (2013.01)

(56) References Cited

U.S. PATENT DOCUMENTS

| | | | | |
|---|---|---|---|---|
| 2012/0156577 | A1* | 6/2012 | Bulovic | C25B 11/04 205/633 |
| 2014/0349212 | A1 | 11/2014 | Tezuka et al. | |
| 2016/0199821 | A1 | 7/2016 | Yoo et al. | |
| 2020/0208277 | A1* | 7/2020 | Kim | C25B 11/089 |
| 2023/0366108 | A1* | 11/2023 | Liu | C25B 9/23 |

FOREIGN PATENT DOCUMENTS

| | | | |
|---|---|---|---|
| WO | 2021138723 | A1 | 7/2021 |
| WO | 2022031947 | A1 | 2/2022 |
| WO | 2022184684 | A2 | 9/2022 |

* cited by examiner

SYSTEMS AND METHODS FOR WATER ELECTROLYSIS WITH ELECTRODES HAVING TRANSITION METAL-PHOSPHOROUS-BASED COMPOUNDS

TECHNICAL FIELD

The present invention generally relates to systems and methods for water electrolysis, and more particularly relates to systems and methods that include electrodes having transition metal-phosphorous-based compounds.

BACKGROUND

Interest in alternative energy sources continues to grow, particularly for applications that utilize hydrogen. As such, there is an ongoing demand for efficient methods of hydrogen production. One possible approach to sustainable hydrogen production is water electrolysis. Water electrolysis, also known as "water splitting," is the decomposition of liquid water ($H_2O$) into oxygen gas ($O_2$) and hydrogen gas ($H_2$). This process includes passing an electric current through water with a voltage applied across an anode and a cathode. Hydrogen gas is produced at the cathode and oxygen gas is produced at the anode. To improve current densities, and therefore increase the gases produced, water electrolysis typically includes a liquid electrolyte in the water or an ion exchange membrane (polymer electrolyte) between the anode and the cathode.

Water electrolysis includes two half reactions including hydrogen evolution reaction (HER) at the cathode and oxygen evolution reaction (OER) at the anode. Efficiency of water electrolysis may be promoted by increasing electrochemical performance of electrode materials by, for example, providing a catalyst to increase the reaction rate of the half reactions occurring at the cathode, anode, or both. Often, catalyst materials include noble metals or rare earth oxides. Although these materials provide high performance, they are not amenable to large-scale application due to their high cost and scarcity. Therefore, there is an ongoing desire for efficient catalyst materials that are low-cost and abundant.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

A system is provided for water electrolysis. The system includes an ion exchange membrane, a first electrode catalyst layer on a first side of the ion exchange membrane, wherein the first electrode catalyst layer includes a transition metal-phosphorus-based compound electroplated to the first side of the ion exchange membrane, and a second electrode catalyst layer on a second side of the ion exchange membrane opposite the first side.

A system is provided for water electrolysis. The system includes an ion exchange membrane, an anode catalyst layer on a first side of the ion exchange membrane, wherein the anode catalyst layer includes a transition metal-phosphorus-based compound on the first side of the ion exchange membrane, and a cathode catalyst layer on a second side of the ion exchange membrane opposite the first side, wherein the cathode catalyst layer includes a compound comprising the transition metal on the second side of the ion exchange membrane.

A method is provided for performing water electrolysis. The method includes providing an electrochemical cell that includes an ion exchange membrane, an anode catalyst layer that includes a transition metal-phosphorus-based compound on a first side of the ion exchange membrane, a cathode catalyst layer that includes a compound comprising the transition metal on a second side of the ion exchange membrane opposite the first side, an anode-side porous transport layer adjacent the anode catalyst layer and a cathode-side porous transport layer adjacent the cathode catalyst layer, each of the anode-side porous transport layer and the cathode-side porous transport layer includes a stainless steel wire mesh coated with an alloy of the transition metal, an anode-side bipolar plate adjacent the anode-side porous transport layer and a cathode-side bipolar plate adjacent the a cathode-side porous transport layer, each of the anode-side bipolar plate and the cathode-side bipolar plate includes a stainless steel plate coated with an alloy of the transition metal, feeding water to the electrochemical cell, and applying a voltage between the anode catalyst layer and the cathode catalyst layer that is sufficient to cause the water to be decomposed into oxygen ($O_2$) on the first side and hydrogen ($H_2$) on the second side.

Furthermore, other desirable features and characteristics of the systems and methods will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
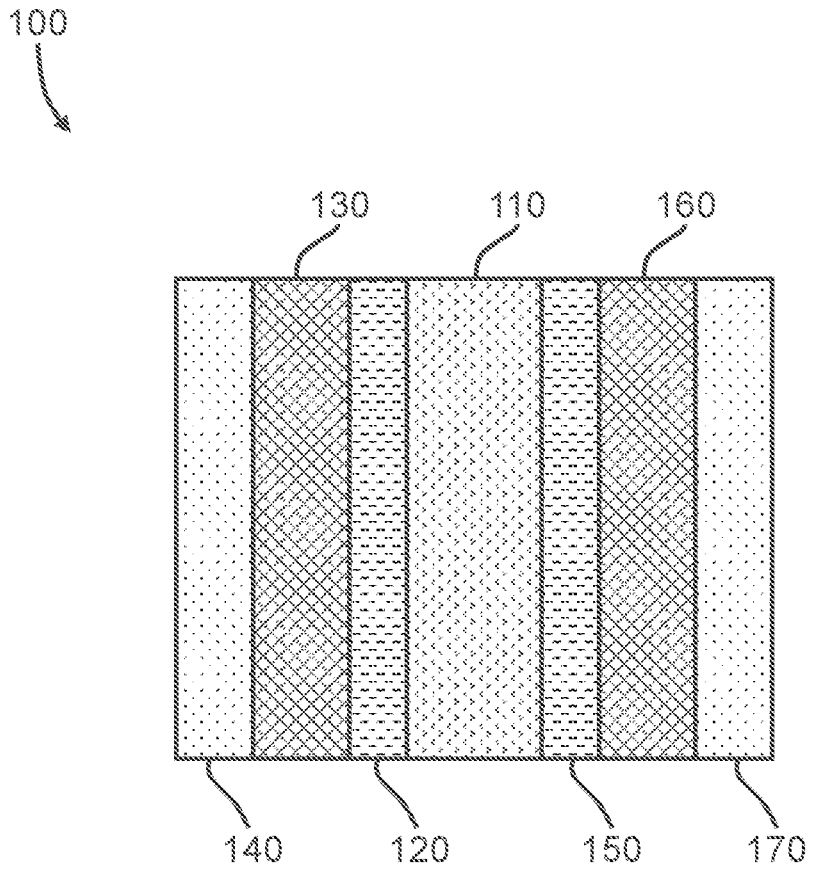
FIG. 1 is a diagram that schematically represents a system comprising an anion exchange membrane (AEM) in accordance with various embodiments.

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Systems and methods disclosed herein provide for production of hydrogen from water via water hydrolysis (i.e., water splitting). Electrolysis of water is the decomposition of water ($H_2O$) into oxygen ($O_2$) and hydrogen ($H_2$) due to an electric current being passed through the water. The systems generally include an anode (or an anode catalyst layer), a cathode (or a cathode catalyst layer), and an electrolyte material separating the anode and the cathode. Notably, the systems disclosed herein include at least one electrode having a compound comprising phosphorus and a transition metal (e.g., iron (Fe), cobalt (Co), nickel (Ni)). In various embodiments, one or both of the electrodes include a cobalt-phosphorus-based compound (Co—P), an iron-phosphorus-based compound (Fe—P), a nickel-phosphorus-based compound (Ni—P), a cobalt-nickel-phosphorus-based compound (Co—Ni—P), or a nickel-cobalt-phosphorus-based compound (Ni—Co—P). Suitable compounds include but are not limited to cobalt phosphide, cobalt phosphate, iron phosphide, iron phosphate, nickel phosphide, nickel phosphate, etc. The systems may have various structures that utilizes various electrolysis techniques.

In various embodiments, the system may include an anode and a cathode separated by an ion exchange membrane. An ion exchange membrane is a semipermeable membrane configured to conduct ions (e.g., hydrogen ion ($H^+$) or hydroxide ions ($OH^-$)) and water from the cathode to the anode while simultaneously functioning as a reactant barrier (e.g., impedes transport of gases such as oxygen ($O_2$) or hydrogen ($H_2$)). The anode and the cathode may be defined by an anode catalyst layer deposited on a first side of the ion exchange membrane (referred to as the anode-side) and a cathode catalyst layer deposited on a second side of the ion exchange membrane (referred to as the cathode-side) opposite the anode-side. The system may further include porous transport layers (PTLs) adjacent the anode and cathode catalyst layers configured to facilitate gas diffusion. The ion exchange membrane, anode catalyst layer, cathode catalyst layer, and PTLs in combination define an electrochemical cell. Bipolar plates may be provided to enclose the electrochemical cell and may include ports for transport of liquids and gases therethrough (e.g., water, hydrogen, oxygen). In various embodiments, the system may include more than one electrochemical cells arranged in a stack. In such embodiments, individual bipolar plates may function as both anode-side plates and cathode-side plates for adjacent electrochemical cells, that is, one or more of the bipolar plates may include flow paths, ports, channels, or the like provided on both sides thereof.

In various embodiments, the ion exchange membrane may be configured to conduct anions (e.g., hydroxide ions ($OH^-$)) from the cathode catalyst layer to the anode catalyst layer. FIG. 1 presents an exemplary first system 100 configured for electrolysis that includes an AEM 110, an anode catalyst layer 120, an anode-side porous transport layer (PTL) 130, an anode-side bipolar plate 140, a cathode catalyst layer 150, a cathode-side PTL 160, and a cathode-side bipolar plate 170.

The AEM 110 may be formed of various materials including certain ionomers, typically comprising polymer or composite materials. In some embodiments, the AEM 110 includes a polymer material (backbone) having cationic ion-exchange groups tethered thereto (e.g., cations covalently bonded thereto). Exemplary but nonlimiting materials include poly(fluorenyl-co-aryl piperidinium) (PFAP)-based and polybenzimidazole-based materials (e.g., doped with alkaline salts).

Figure 2:
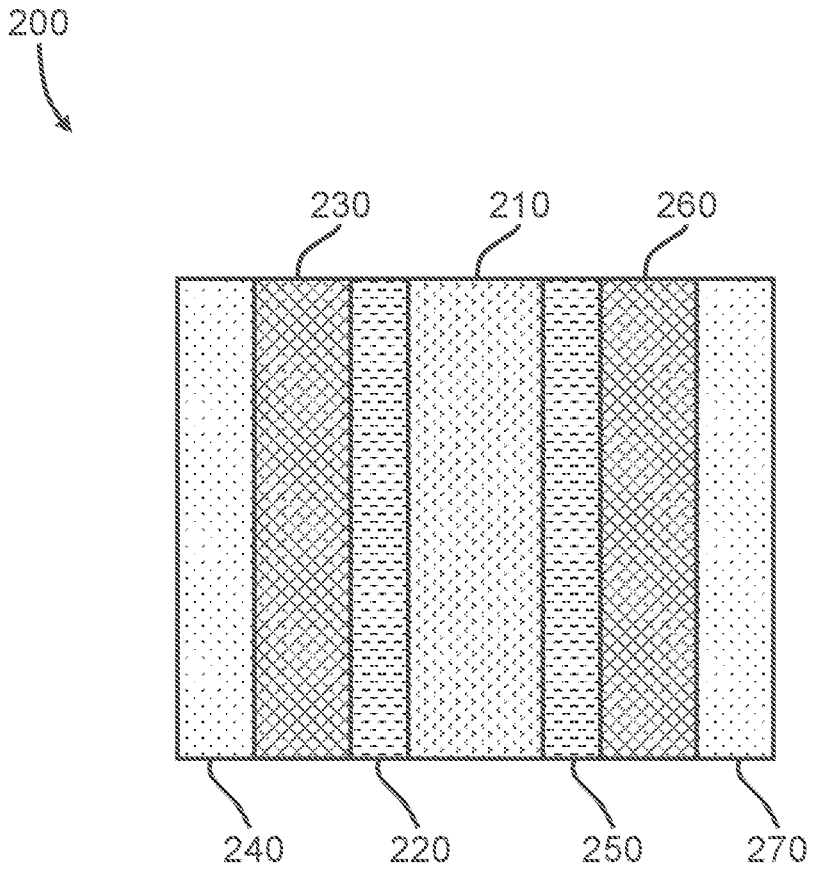
FIG. 2 is a diagram that schematically represents a system comprising a proton exchange membrane (PEM) in accordance with various embodiments.

In various embodiments, the ion exchange membrane may be a proton exchange membrane (PEM) configured to conduct protons (e.g., hydrogen ion ($H^+$)) from the anode catalyst layer to the cathode catalyst layer. FIG. 2 presents an exemplary second system 200 configured for electrolysis that includes a PEM 210, an anode catalyst layer 220, an anode-side porous transport layer (PTL) 230, an anode-side bipolar plate 240, a cathode catalyst layer 250, a cathode-side PTL 260, and a cathode-side bipolar plate 270.

The PEM 210 may be formed of various materials including certain ionomers, typically comprising polymer or composite materials. In some embodiments, the PEM 210 includes a polymer material (backbone) having anionic ion-exchange groups tethered thereto (e.g., anions covalently bonded thereto). Exemplary but nonlimiting materials include fluorinated polymers, partially fluorinated polymers, and polyaromatic polymers. A particular example includes a fluoropolymer (PFSA) commercially available under the tradename Nafion® from The Chemours Company FC, LLC.

The anode catalyst layers 120, 220 of FIGS. 1 and 2, respectively, may include various materials including, but not limited to, compounds comprising phosphorus and a transition metal (e.g., iron (Fe), cobalt (Co), nickel (Ni)). In various embodiments, the anode catalyst layers 120,220 include a Co—P-based alloy, an Fe—P-based alloy, or a Ni—P-alloy.

The cathode catalyst layers 150, 250 of FIGS. 1 and 2, respectively, may include various materials including, but not limited to, compounds comprising noble metals (e.g., platinum (Pt), gold (Ag), palladium (Pd), iridium (Ir), rhodium (Rh), ruthenium (Ru)) and alloys thereof, compounds comprising rare earth oxides (e.g., neodymium (III) oxide), and compounds comprising phosphate and a transition metal (e.g., iron (Fe), cobalt (Co), nickel (Ni)). In various embodiments, the cathode catalyst layers 150, 250 include a compound comprising an alloy of the same transition metal(s) provided in the anode catalyst layers 120, 220 (e.g., a cobalt-based alloy, an iron-based alloy, or a nickel-based alloy).

The anode-side PTLs 130, 230 and the cathode-side PTLs 160, 260 may be formed of various materials that provide high electron conductivity, high gas diffusivity, optionally, high corrosion resistance. In various embodiments, the anode-side PTLs 130, 230 and the cathode-side PTLs 160, 260 may include a wire mesh or matrix formed of a metallic material having a coating thereon comprising a metal or alloy that is chemically similar to the corresponding anode catalyst layer 120/220 or cathode catalyst layer 150/250 (e.g., include the same transition metal(s)). In various embodiments, the anode-side PTLs 130, 230 and/or the cathode-side PTLs 160, 260 include a wire mesh formed of, for example, titanium, aluminum, nickel, copper, zinc, or stainless steel (e.g., SS 304, SS 316, SS 430, SS A-286, etc.) and having a coating thereon comprising a transition metal-based compound, such as a cobalt-based alloy, an iron-based alloy, or a nickel-based alloy. In various embodiments, the anode-side PTLs 130, 230 and/or the cathode-side PTLs 160, 260 may be electrically connected to the corresponding anode catalyst layer 120/220 or cathode catalyst layer 150/250, such that the anode-side PTLs 130, 230 and/or the cathode-side PTLs 160, 260 forms part of the corresponding electrode.

The anode-side bipolar plates 140, 240 and the cathode-side bipolar plates 170, 270 may be formed of various materials that are rigid and, optionally, have high corrosion resistance. In various embodiments, the anode-side bipolar plates 140, 240 and the cathode-side bipolar plates 170, 270 may include a metallic, ceramic, polymeric, or composite plate having a coating thereon comprising a metal or alloy that is chemically similar to the corresponding anode catalyst layer 120/220 or cathode catalyst layer 150/250 (e.g., include the same transition metal(s)). In various embodiments, the anode-side PTLs 130, 230 and/or the cathode-side PTLs 160, 260 include a metallic plate (e.g., titanium, aluminum, nickel, copper, zinc, or stainless steel (e.g., SS 304, SS 316, SS 430, SS A-286, etc.)) having a coating thereon comprising a transition metal-based compound such as a cobalt-based alloy, an iron-based alloy, or a nickel-based alloy.

Figure 3:
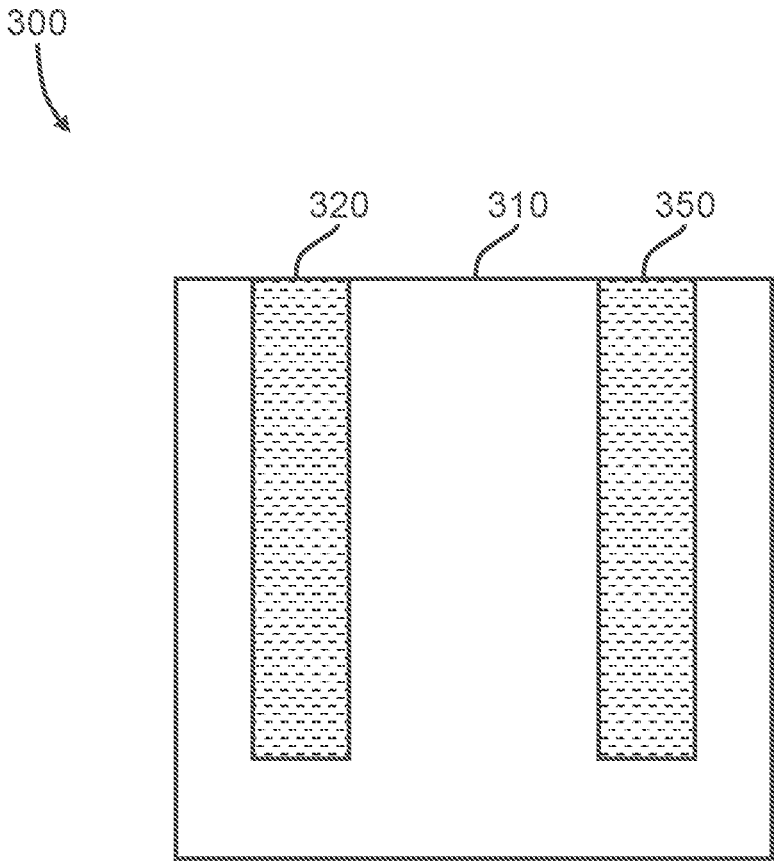
FIG. 3 is a diagram that schematically represents a system comprising an anode and a cathode separated by a liquid alkaline electrolyzer in accordance with various embodiments.

The systems and methods are not limited to embodiments that include an ion exchange membrane. For example, in various embodiments, the system may include an anode and a cathode separated by an alkaline electrolyzer configured to conduct anions (e.g., hydroxide ions ($OH^-$)) from the cathode to the anode with hydrogen being generated on the cathode side. Exemplary but nonlimiting electrolyzers may include a liquid alkaline solution of sodium hydroxide or potassium hydroxide. FIG. 3 presents an exemplary third system 300 configured for electrolysis that includes a solution of an electrolyzer 310, an anode 320, and a cathode 350. The anode 320 and/or the cathode 350 may include materials such as those noted above for the anode catalyst layers 120, 220 and the cathode catalyst layers 150, 250.

The first, second, and third systems 100, 200, 300 may be produced using various techniques and technologies.

In various embodiments, the anode catalyst layers 120, 220 may be formed by providing the ion exchange membrane (e.g., the AEM 110/PEM 210) and electroplating a metallic coating thereon. As a specific but nonlimiting example, the anode catalyst layers 120, 220 may be formed by providing the AEM 110/PEM 210, locating at least a portion of the AEM 110/PEM 210 in a cobalt phosphate solution, and depositing a coating comprising a cobalt (II) phosphate-based alloy ($CO_3(PO_4)_2$) on the AEM 110/PEM 210 via an electroplating process. In various embodiments, the anode 320 may be formed by providing a core material (e.g., titanium, stainless steel, etc.), locating at least a portion of the core material in a cobalt phosphate solution, and depositing a coating comprising a cobalt (II) phosphate-based alloy ($CO_3(PO_4)_2$) on the core material via an electroplating process.

In various embodiments, one or more intermediate layers may be provided between the anode catalyst layers 120, 220 and the ion exchange membrane (e.g., the AEM 110/PEM 210). For example, in certain embodiments, a cobalt-based alloy may be deposited onto the AEM 110/PEM 210 via electroplating, and then the anode catalyst layer 120/220 may be formed thereon by electroplating thereon a coating comprising a cobalt (II) phosphate-based alloy ($CO_3(PO_4)_2$).

In various embodiments, the cathode catalyst layers 150, 250 may be formed by providing the ion exchange membrane (e.g., the AEM 110/PEM 210) and electroplating a metallic coating thereon. As a specific but nonlimiting example, the cathode catalyst layers 150, 250 may be formed by providing the AEM 110/PEM 210 and producing a coating thereon comprising a cobalt-based alloy via electroplating.

In various embodiments, the anode-side PTLs 130, 230 and the cathode-side PTLs 160, 260 may be formed by providing a metallic wire mesh (e.g., titanium, stainless steel, etc.) and electroplating the metallic wire mesh with a metallic coating. As a specific but nonlimiting example, the anode-side PTLs 130, 230 and the cathode-side PTLs 160, 260 may be formed by providing a stainless steel wire mesh and producing a coating thereon comprising a cobalt-based alloy via electroplating.

In various embodiments, the anode-side bipolar plates 140, 240 and the cathode-side bipolar plates 170, 270 may be formed by providing a metallic plate (e.g., titanium, stainless steel, etc.) and electroplating the metallic plate with a metallic coating. As a specific but nonlimiting example, the anode-side bipolar plates 140, 240 and the cathode-side bipolar plates 170, 270 may be formed by providing a stainless steel plate and producing a coating thereon comprising a cobalt-based alloy via electroplating.

Exemplary materials for certain layers of the anode-side PTL 130, 230, the anode-side bipolar plate 140, 240, the cathode-side PTL 160, 260, and the cathode-side bipolar plate 170, 270, and exemplary methods for depositing certain layers of the anode catalyst layer 120, 220, the anode 320, the cathode catalyst layer 150, 250, the cathode 350, the anode-side PTL 130, 230, the anode-side bipolar plate 140, 240, the cathode-side PTL 160, 260, and the cathode-side bipolar plate 170, 270 are disclosed in U.S. Patent Application Publication No. 2019/0292674 A1 to Ilgar et al., incorporated herein in its entirety.

Figure 4:
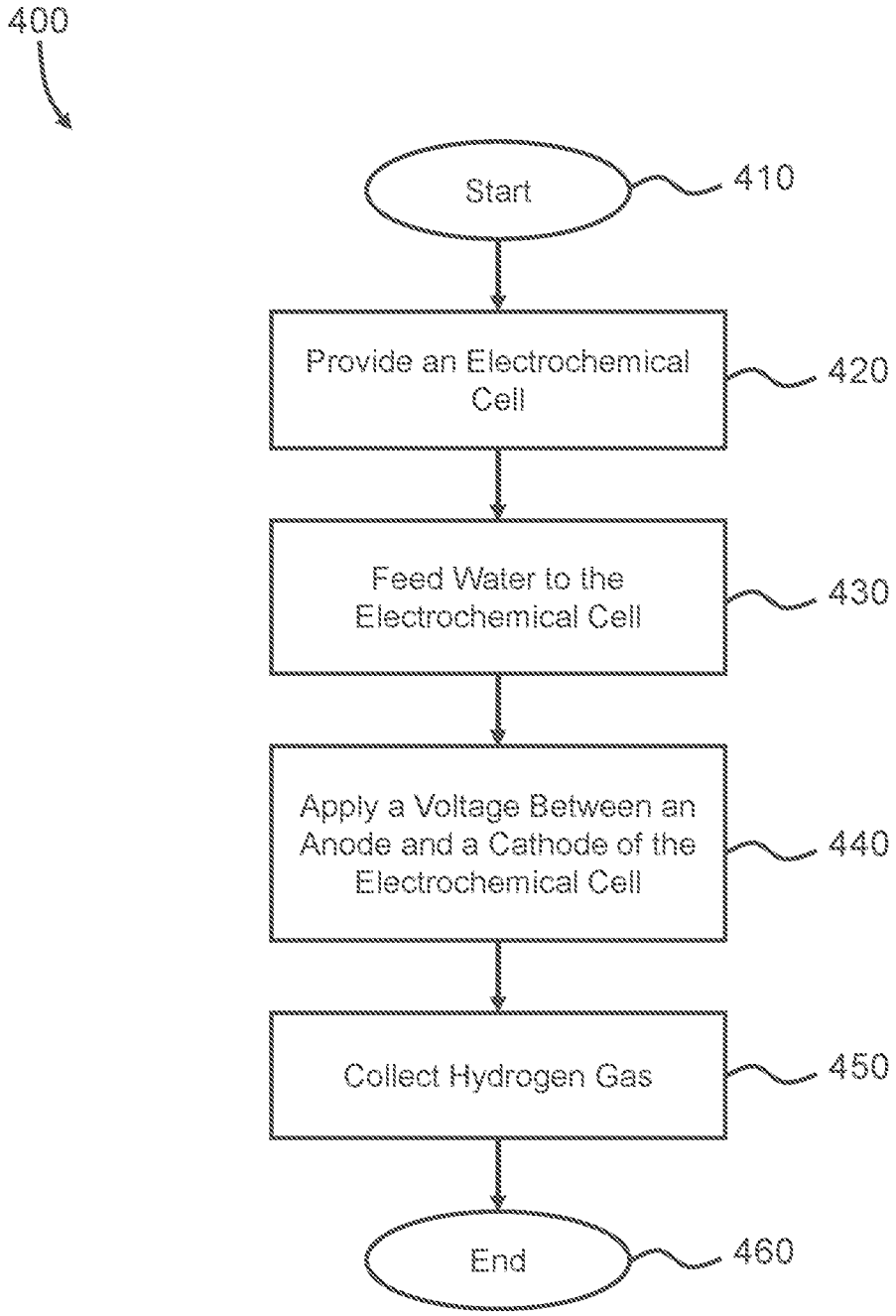
FIG. 4 is a flow chart representing a method of generating hydrogen via water electrolysis in accordance with various embodiments.

The systems disclosed herein, including the first, second, and third systems 100, 200, 300, provide for methods of generating hydrogen gas and oxygen gas from water via water electrolysis. For example, FIG. 4 is a flow chart illustrating a nonlimiting method 400 for generating hydrogen gas. The method 400 may begin at 410 and provide one or more electrochemical cells, such as those described herein for the first and second systems 100, 200, at 420. An electrolyte solution (e.g., water, KOH, etc.) may be fed to the electrochemical cell(s) at 430 and then a voltage may be applied at 440 between an anode (e.g., the anode catalyst layer 120/220) and a cathode (e.g., the cathode catalyst layer 150/250) of the electrochemical cell(s) (e.g., at a voltage of 1.23V or more). While the voltage is being applied at 440, water of the electrolyte solution is decomposed into oxygen ($O_2$) at the anode and hydrogen ($H_2$) at the cathode. The method 400 may include collecting, storing, and/or using the produced hydrogen gas and/or the produced oxygen gas at 450. The method 400 may end at 460.

The systems disclosed herein, including the first, second, and third systems 100,200,300, may be portions of a larger system configured for various purposes such as hydrogen gas generation, oxygen generation, and/or power generation. In various embodiments, the system is a portion of an industrial system configured for hydrogen production. In various embodiments, the system is a portion of a fuel cell configured for electricity generation.

The systems and methods disclosed herein provide various benefits over certain existing systems and methods. For example, embodiments that include the anode catalyst layers 120, 220 with the transition metal-phosphorus-based compound may provide high electrolysis efficiency with improved corrosion resistance relative to, for example, nickel-based or stainless steel-based anodes, and improved abundance and reduced cost relative to, for example, platinum and rare earth oxides. As another example, embodiments that include electroplating transition metal alloy-based coatings on one or more of the anode catalyst layers 120, 220, the cathode catalyst layers 150, 250, the anode-side PTLs 130, 230, the cathode-side PTLs 160, 260, the anode-side bipolar plates 140, 240, and the cathode-side bipolar plates 170, 270 may provide improved corrosion resistance in alkaline electrolytes relative to, for example, nickel-based or stainless steel-based alloys, allow for use of low cost substrates, such as stainless steels, provide improved adhesion relative to various other deposition methods, and provide for ease of distribution of the coating over an entirety of surfaces of the substrates. As yet another example, embodiments that include the anode catalyst layers 120, 220 with the transition metal-phosphorus-based compound and one or more of the anode-side PTLs 130, 230, the cathode-side PTLs 160, 260, the anode-side bipolar plates 140, 240, and the cathode-side bipolar plates 170, 270 with a coating thereon comprising a compound with the same transition metal(s) as the anode catalyst layers 120, 220 may provide improvements to electrode stability due to similarity of the materials, and may provide a synergistic effect that provides additional catalytical reactivity.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A system for water electrolysis, the system comprising:

an ion exchange membrane, wherein the ion exchange membrane is a proton exchange membrane;

a first electrode catalyst layer on a first side of the ion exchange membrane, wherein the first electrode catalyst layer comprises a transition metal-phosphorus-based compound electroplated to the first side of the ion exchange membrane, wherein the first electrode catalyst layer is an anode catalyst layer and the transition metal-phosphorus-based compound is a cobalt-phosphorus-based compound;

a second electrode catalyst layer on a second side of the ion exchange membrane opposite the first side, wherein the second electrode catalyst layer is a cathode catalyst layer and the cathode catalyst layer comprises a cobalt-based compound on the second side of the ion exchange membrane;

an anode-side porous transport layer adjacent the anode catalyst layer and a cathode-side porous transport layer adjacent the cathode catalyst layer, wherein each of the anode-side porous transport layer and the cathode-side porous transport layer comprising a metallic wire mesh, and wherein at least the metallic wire mesh of the anode-side porous transport layer is coated with a cobalt-based alloy; and an anode-side bipolar plate adjacent the anode-side porous transport layer and a cathode-side bipolar plate adjacent the cathode-side porous transport layer, wherein at least the anode-side bipolar plate includes a plate coated with the cobalt-based alloy.

2. The system of claim 1, wherein the second electrode catalyst layer is electroplated to the second side of the ion exchange membrane.

3. The system of claim 1, wherein the metallic wire mesh of the anode-side porous transport layer and the cathode-side porous transport layer is formed of a stainless steel.

4. The system of claim 1, wherein each of the anode-side bipolar plate and the cathode-side bipolar plate include a plate formed of stainless steel.

5. The system of claim 1, wherein the anode catalyst layer and the cathode catalyst layer are electroplated to the first side and the second side of the ion exchange membrane, respectively.

6. A method of performing water electrolysis, the method comprising:

providing an electrochemical cell comprising an ion exchange membrane, wherein the ion exchange membrane is a proton exchange membrane, an anode catalyst layer comprising a cobalt-phosphorus-based compound on a first side of the ion exchange membrane, a cathode catalyst layer comprising a cobalt-based compound on a second side of the ion exchange membrane opposite the first side, an anode-side porous transport layer adjacent the anode catalyst layer and a cathode-side porous transport layer adjacent the cathode catalyst layer, each of the anode-side porous transport layer and the cathode-side porous transport layer comprising a stainless steel wire mesh coated with a cobalt-based alloy, an anode-side bipolar plate adjacent the anode-side porous transport layer and a cathode-side bipolar plate adjacent the cathode-side porous transport layer, each of the anode-side bipolar plate and the cathode-side bipolar plate comprising a stainless steel plate coated with the cobalt-based alloy;

feeding water to the electrochemical cell; and applying a voltage between the anode catalyst layer and the cathode catalyst layer that is sufficient to cause water to be decomposed into oxygen (O2) on the first side and hydrogen (H2) on the second side.

7. The method of claim 6, wherein providing the electrochemical cell includes electroplating the anode catalyst layer and the cathode catalyst layer to the first side and the second side of the ion exchange membrane, respectively.

* * * * *